US005450694A

United States Patent [19]

Goranson et al.

[11] Patent Number: 5,450,694

[45] Date of Patent: Sep. 19, 1995

[54] MOVABLE SCREEN PARTITION

[75] Inventors: Per Goranson; Orjan Goranson, both of Falkenberg, Sweden

[73] Assignee: Silentia AB, Falkenberg, Sweden

[21] Appl. No.: 151,933

[22] Filed: Nov. 15, 1993

Related U.S. Application Data

[63] Continuation-in-part of Ser. No. 859,386, May 26, 1992, abandoned.

[30] Foreign Application Priority Data

Nov. 24, 1989 [SE] Sweden ..... 8903961

[51] Int. Cl.[6] ..... E04B 7/16

[52] U.S. Cl. ..... 52/71; 52/238.1; 16/225; 16/382; 16/DIG. 13; 160/135

[58] Field of Search ..... 52/71, 280, 281, 238.1, 52/470, 578, 581, 582.1, 582.2, 64, 65, 277, 240; 160/229.1, 231.1, 231.2, 135; 16/225, 382, DIG. 13; 248/601, 129

[56] References Cited

U.S. PATENT DOCUMENTS

| | | | |
|---|---|---|---|
| 3,232,333 | 2/1966 | Dixon | 160/231.2 X |
| 4,450,658 | 5/1984 | Legeai | 52/240 X |
| 5,092,385 | 3/1992 | Bealieu | 160/231.2 X |
| 5,272,848 | 12/1993 | Maas | 52/238.1 |

*Primary Examiner*—Carl D. Friedman
*Assistant Examiner*—Creighton Smith
*Attorney, Agent, or Firm*—Antonelli, Terry, Stout & Kraus

[57] ABSTRACT

An extendible and retractable screen partition, and a hinge device suitable for incorporation into such a screen partition. The screen partition includes panel-shaped elements interconnected by hinge devices. A releasable fastener secures one end panel-shaped element to a wall. A telescoping leg extends from the bottom of the other end panel-shaped element. Preferably, this leg is spring-biased outwardly and has a wheel on its end, with a brake to secure the end panel-shaped element in a desired position. A second telescoping leg can extend from one of the centrally disposed panel-shaped elements. The hinge device includes first and second hollow body members having three interconnected curved wall portions, with an anchor extending from a concave surface of one of the wall portions to secure the hinge device to a panel-shaped element of a screen partition or other structure. Preferably the wall portions are resilient. An articulation member joins the two body members and permits pivoting of the hinge device, and thus the panel-shaped elements, as the screen partition is extended and retracted.

19 Claims, 7 Drawing Sheets

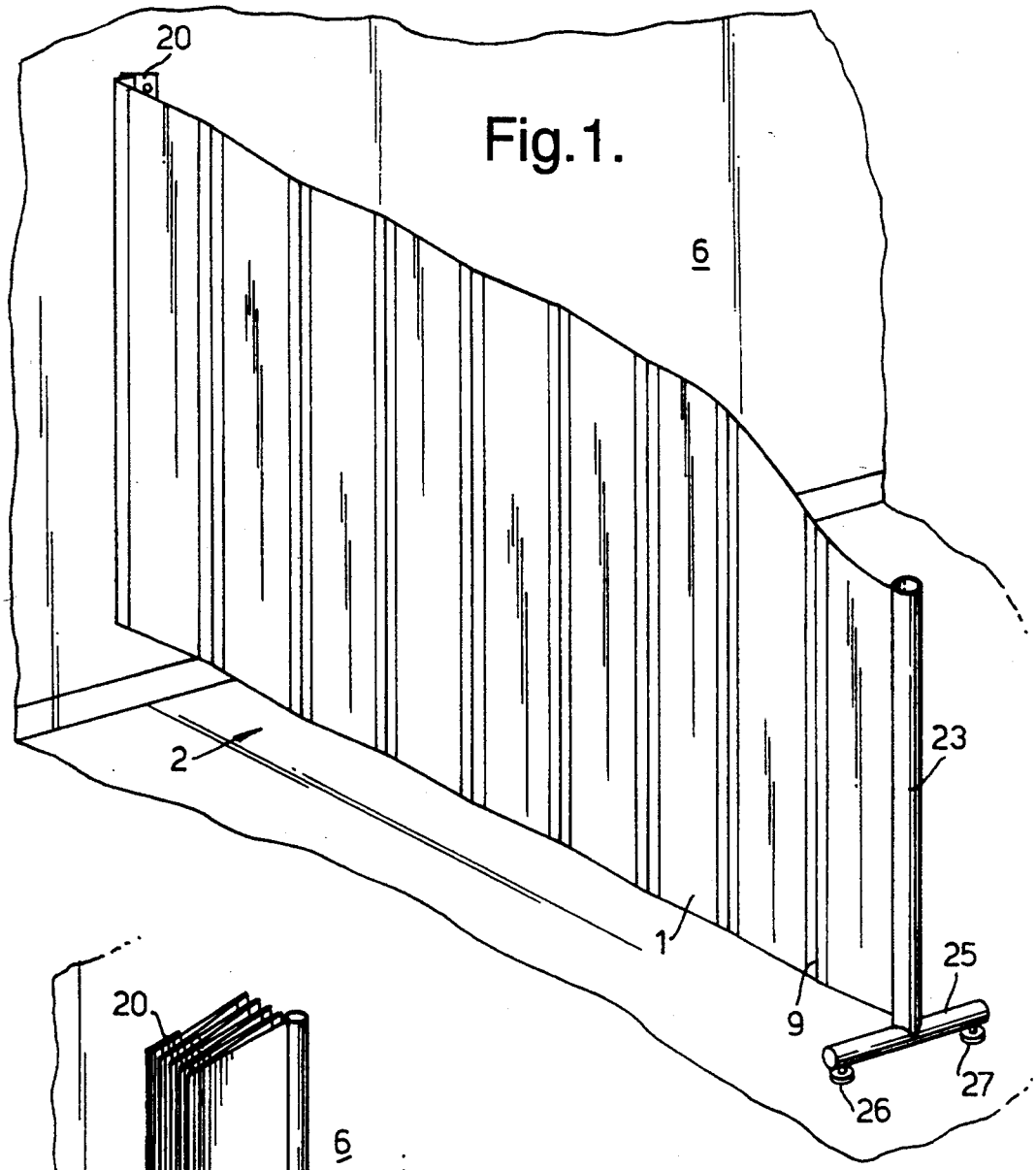
Fig.1.
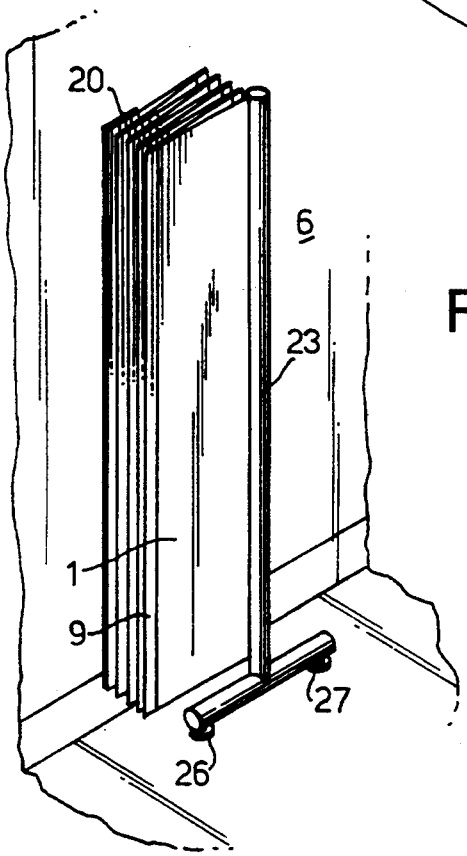
Fig.2.
Fig.3.
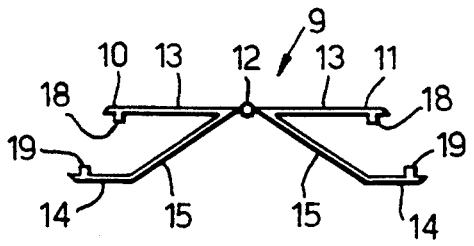

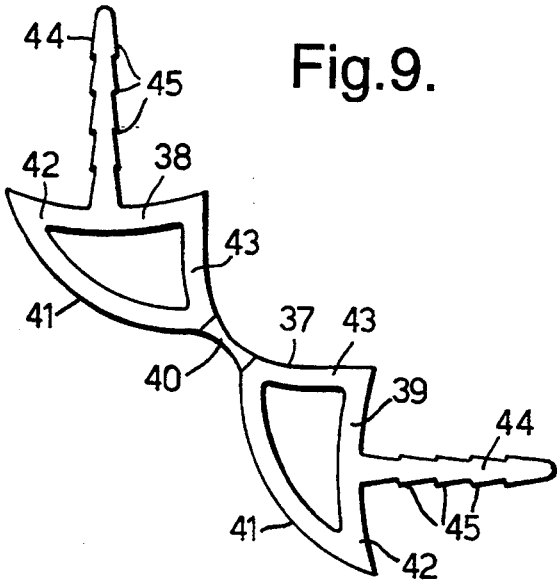
Fig.9.
Fig.10.
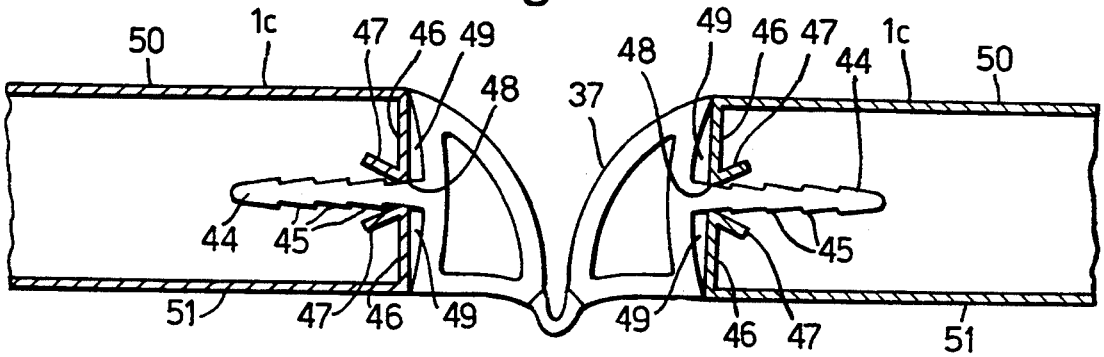
Fig.11.
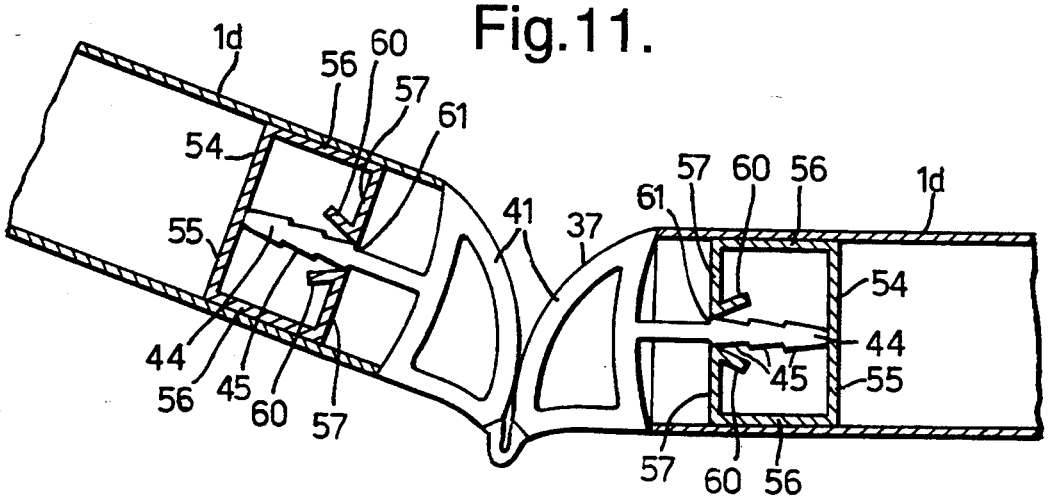

MOVABLE SCREEN PARTITION

CROSS-REFERENCE TO RELATED APPLICATION

This application is a continuation-in-part of U.S. patent application Ser. No. 07/859,386 filed May 26, 1992, abandoned.

BACKGROUND OF THE INVENTION

The present invention relates to an apparatus for providing a movable, for example retractable and extendible, screen partition which is releasably secured to a wall at one side edge. The present invention also relates to a hinge device suitable for incorporation into such a movable screen partition.

Screening-off a small area within a larger area is desirable in many situations. One example is nursing and other medical facilities. Screening-off of an area is also sometimes desirable in business offices, workshops and the like. It is desirable for the screen partition in such situations to be mobile or relocatable in a simple manner. Preferably, the screen partition should more or less disappear when it is no longer immediately needed.

Many prior art screen partitions for such use are more or less permanent and, as a result, are extremely difficult to relocate. There are also wheeled textile frames which are easy to place and to move, but which require considerable storage space when they are not needed. As a consequence, such frames are very often left in place even when not needed, with the result that they restrict the space available and often cause considerable inconvenience, instead of serving as a useful screen.

SUMMARY OF THE INVENTION

The present invention is a movable screen partition which overcomes the above-outlined problems and obviates, or at least reduces, the drawbacks inherent in prior art arrangements of this type. The present invention is also a hinge device suitable for incorporation into such a movable screen partition.

A screen partition apparatus according to the present invention makes it extremely simple to arrange extendible and retractable screen partitions with the aid of but few extremely simple and economical elements. The elements and devices included in the screen partition apparatus according to the present invention are both simple in the design and simple to manufacture from various materials, it being, for example, possible to manufacture all major parts of plastic, aluminum or the like, by extrusion or otherwise. One major advantage inherent in the screen partition apparatus according to the present invention is that a retracted partition may be extended to the desired length in an extremely rapid and efficient manner, quite simply by a single manual operation at one end of the partition. In addition, it is an extremely simple operation to adjust the partition to any optional length. Thus, the partition may be completely or partly extended and retracted in an extremely simple manner. All extending operations may readily be carried out by means of a single maneuver, while retraction may possibly require two manual operations, but this is merely a slight inconvenience, since it is the extending operation which most often needs to be carried out rapidly with one hand. Moreover, the present invention permits angular adjustment of one or more parts of the extended partition and an extremely simple and efficient adaptation to the surface on which it stands.

A hinge device according to the present invention may be readily and inexpensively manufactured. The hinge device provides a pleasing appearance to the movable partition, both when the partition is extended and when it is retracted. The hinge device is formed of two hollow body members interconnected by an articulation member. Each body member is provided with an anchor portion for securely engaging with a panel of the movable partition. The hinge device might be usable in other applications, as well as in a movable partition.

BRIEF DESCRIPTION OF THE DRAWINGS

These and other aspects and advantages of the present invention are more apparent from the following detailed description and claims, particularly when considered with the accompanied drawings. In the drawings:

FIG. 1 is a view of a screen partition, in accordance with one embodiment of the present invention, in the extended state;

FIG. 2 shows the screen partition of FIG. 1 in the retracted or compressed state;

FIG. 3 is a cross-section through a hinge device according to one embodiment of the present invention;

FIG. 9 is an enlarged cross-section through the hinge device of FIG. 8;

Each of FIG. 10, FIG. 11.

DETAILED DESCRIPTION OF PREFERRED EMBODIMENTS

Figure 4:
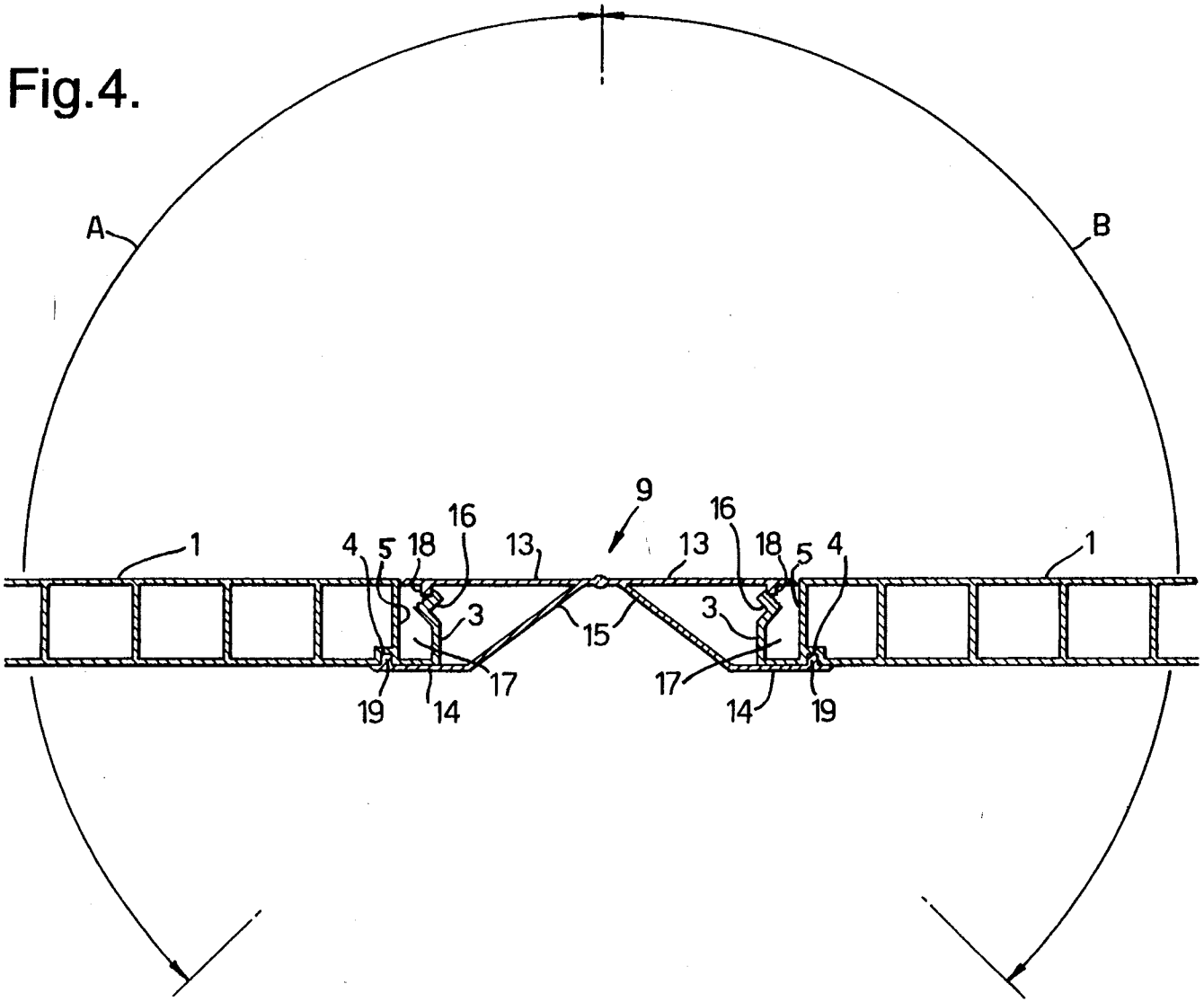
FIG. 4 is a fragmentary cross-section of one extended screen partition utilizing the hinge device of FIG. 3.
Figure 5:
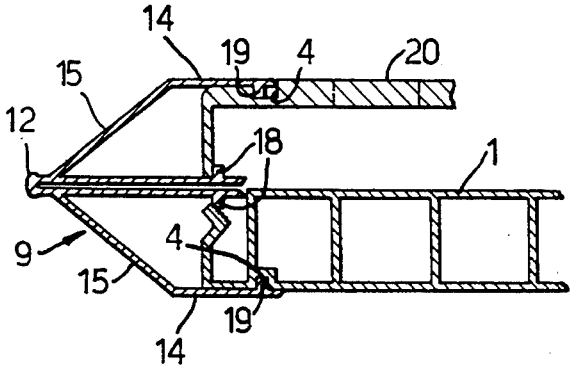
FIG. 5 is a fragmentary cross-section of a retracted screen partition utilizing the hinge device of FIG. 3.

FIG. 1 is a view of a movable screen partition 2 in accordance with one embodiment of the present invention. Partition 2 includes a plurality of panel-shaped elements 1 interconnected by hinge devices 9. The panel-shaped element 1 are of so-called cellular construction and each element 1 consists of an elongate tubular profile with a number of intermediate walls or cell walls which divide up the cavity within the element into a number of cells, as illustrated in FIGS. 4 and 5. The outer walls may be of slightly greater thickness than the cell walls, but this is not required. As depicted in FIG. 4, on two diagonally opposing longitudinal edges, the panel-shaped element 1 has an elongate groove 4 and a bent flange 3. Flange 3 and the adjacent edge 5 of the panel-shaped element 1 form a U-shaped opening 17. Flange 3 has an inward bight 16 which serves as a snap catch device.

Like other elements of an apparatus according to the present invention, the panel-shaped element 1 may be manufactured of plastic, aluminum or other suitable material; however, there is nothing to prevent different elements of the apparatus from being manufactured from different materials, so long as the mix of materials does not entail a risk of corrosion or other inconveniences.

FIG. 3 shows a cross-section through one embodiment of a hinge device 9 according to the present invention. The hinge device 9 consists of two substantially identical portions 10 and 11 interconnected by means of an articulation member 12. The articulation member 12 may consists of the same material as the portions 10 and 11, or some other suitable, perhaps softer, material, and may be united with the portions 10 and 11, for example molded, glued together, etc. The portions 10 and 11 have two parallel walls 13 and 14 which are interconnected by means of a web 15. On the inside of the free ends of the walls 13 and 14 there are provided snap catch devices 18 and 19.

FIG. 4 shows the interconnection of two panel-shaped elements 1 with the aid of a hinge device 9 of FIG. 3. The walls 14 of the hinge device 9 extend past the edges of the elements 1, so that the snap catch devices 19 engage in grooves 4, while the ends of the walls 13 with the snap catch devices 18 fit into the openings 17 on the panel-shaped elements 1 formed by flange 3 and engage the snap catch devices 16. By means of the hinge device 9, the two panel-shaped elements 1 are held together and interconnected such that they may readily be pivoted towards one another to the position illustrated in FIG. 5. If several panel-shaped elements 1 are interconnected by means of hinge devices 9, they may, obviously, form a complete partition or screen whose height is determined by the height of the panel-shaped elements 1. In such cases, the hinge devices may be continuous and they may be of the same height as the panel-shaped elements 1, or the hinge devices 9 may be provided at spaced-apart intervals longitudinal along the vertical edges of the panel-shaped elements 1.

FIG. 1 shows the practical application of the hinge device 9 and panel-shaped elements 1 forming a screen partition 2 which is affixed to a wall surface 6 with aid of an anchoring device 20. At the opposite end of the screen partition 2, there is a tube 23. Screen partition 2 may, thus, be maneuvered with the aid of the tube 23 which serves as a handle.

Screen partition 2 is illustrated in FIG. 1 in the extended state and in FIG. 2 in the retracted or collapsed state. As depicted in FIG. 1 and FIG. 2, the lower portion of the tube 23 may have a cross-tube 25, each end of which is provided on the underside with a foot 26 and 27. The feet 26 and 27 may, naturally, be adjustable, in a known manner.

The interconnection of two panel-shaped elements 1 by means of the hinge device 9 is illustrated in FIGS. 4 and 5. The arcs A and B in FIG. 4 illustrate the pivotal extremities of the hinge device 9 of FIG. 3 and, thereby, of the panel-shaped elements 1. On pivoting of the panel-shaped elements 1 to collapse the wall, the elements may reach a position completely adjacent one another as illustrated in FIG. 5, while the webs 15 restrict pivoting of the panel-shaped elements in the other direction.

Figure 6:
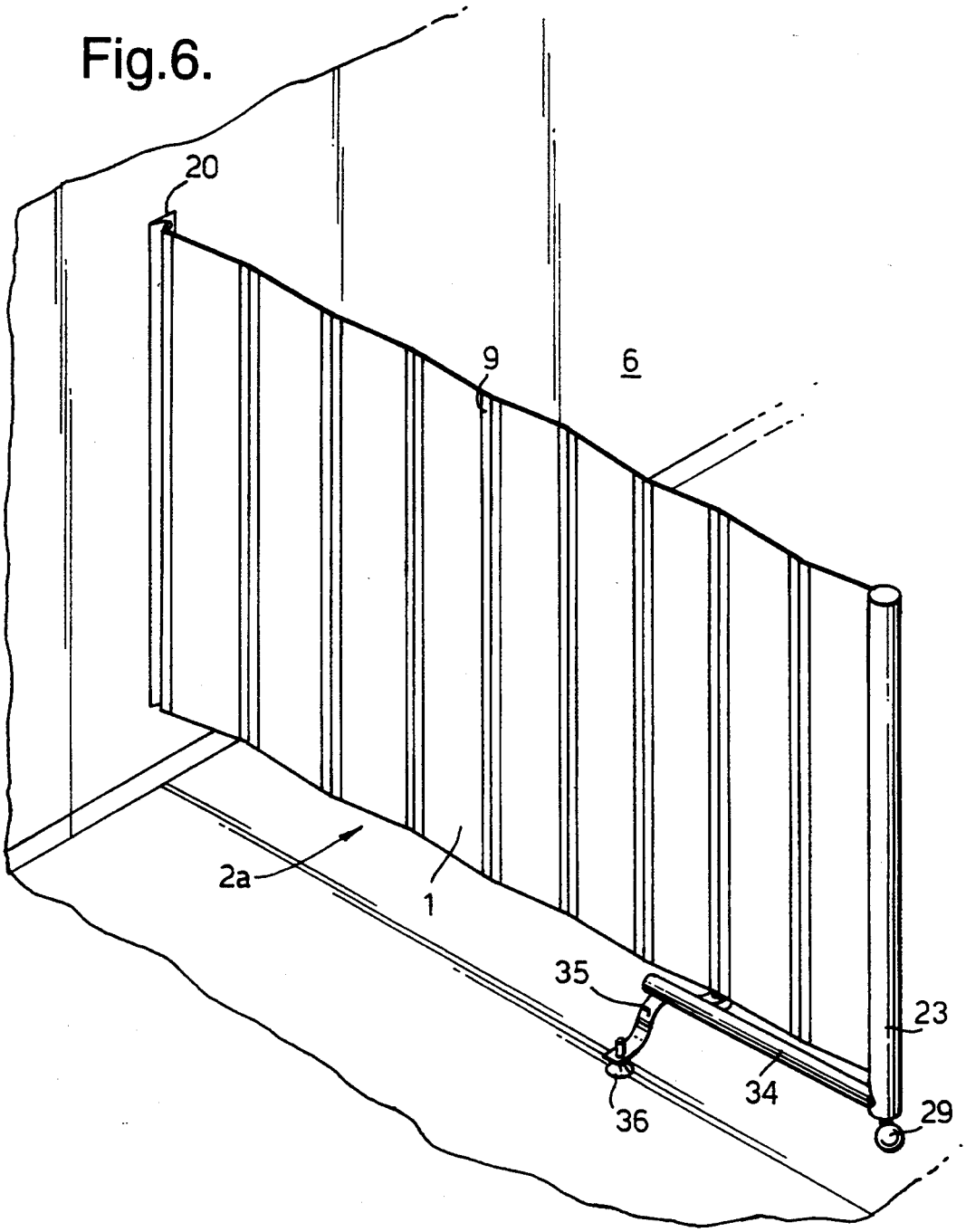
FIG. 6 view of a screen partition in accordance with a modified embodiment of the present invention.

The screen partition **2*a* of FIG. 6 is composed of panel-shaped elements 1 and hinge devices 9. However, the end tube 23 is provided, at its bottom, with a wheel 29, or with a fixed foot such as foot 26, 27. A horizontal tube 34 extends from the lower end of the vertical tube 23 and is directed lengthwise of the partition. At its opposite end from the wheel 29 and the tube 23, the tube 34 is provided with a crosspiece 35 having a foot 36 disposed at each end. A friction material may be provided on the underside of each foot 36. The screen partition 2*a* of FIG. 6 is held in the illustrated position by the force acting on the feet 36 which is of such magnitude that the retraction force is overcome. Alternatively, the wheel 29 may be lockable in a braked condition, and the parts 34–36** omitted.

Figure 7:
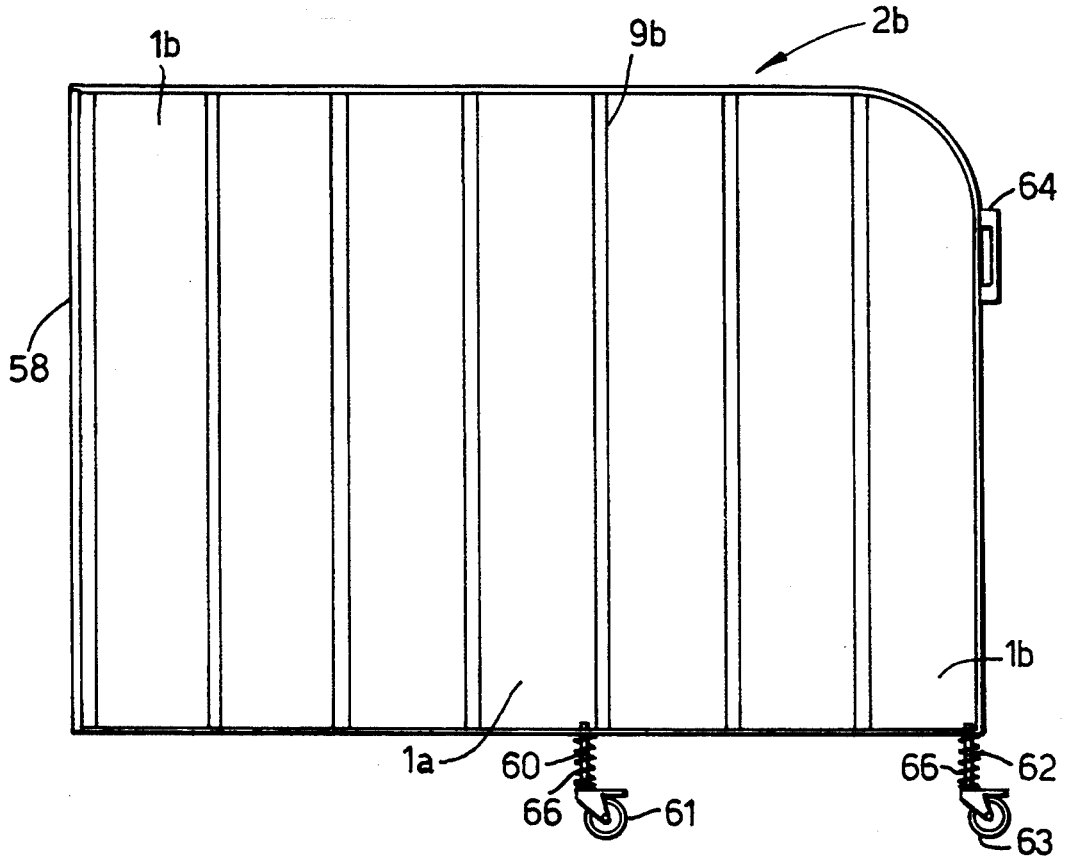
FIG. 7 is a view of a screen partition in accordance with a further embodiment of the present invention.

FIG. 7 illustrates a further embodiment of the present invention in the form of an extendible and retractable screen partition **2*b* which is composed of panel-shaped elements 1 and hinge devices 9. One of the centrally-disposed panel-shaped elements 1*a* is provided at the bottom with a telescopic leg 60 having a support wheel 61 at its lower end. The outermost panel-shaped element 1*b* is also provided with a telescopic leg 62 with a support wheel 63. The support wheels 61 and 63 are pivotal and lockable in a braked condition. Each telescopic leg 60 and 62 is provided with a spring 66 for constant urging of the support wheels 61 and 63** against the floor or other surface, whereby unevenness in the surface may be compensated for.

The outermost element **1*b* is further provided with a handle 64 for maneuvering the screen partition 2*b*. After extending of the screen partition and locking of the support wheel 61 in the braked condition, that portion of the screen partition formed by the outer panel-shaped element 1, between wheels 61 and 63, may be positioned at a different angle than the portion formed by the inner elements 1. After locking of the support wheel 63** in the braked position, the outer portion of the partition will remain in the desired position.

Figure 8:
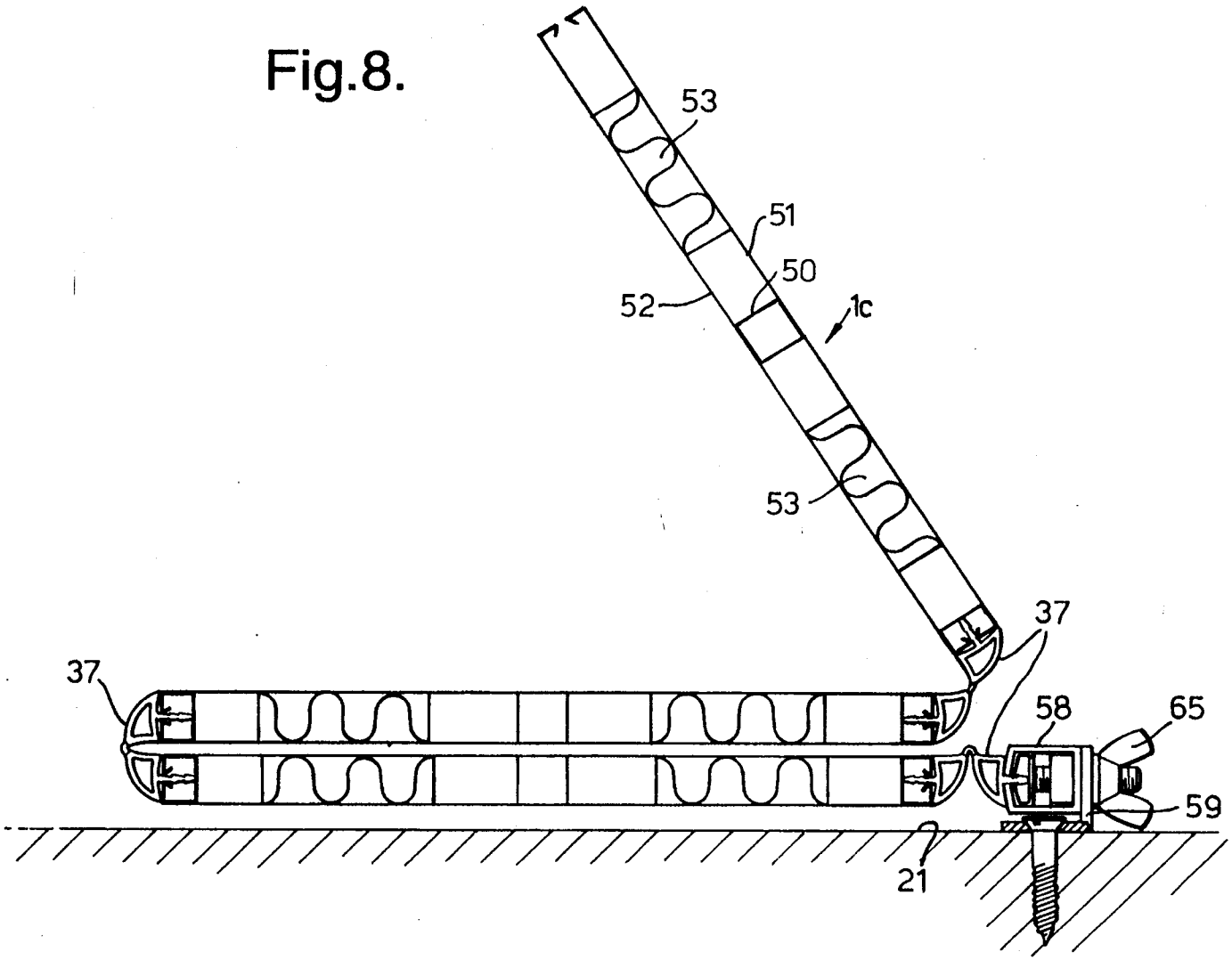
FIG. 8 is a fragmentary cross-section through a screen partition and hinge device in accordance with further embodiments of the present invention.

FIG. 8 illustrates a further embodiment of panel-shaped elements **1*c*, as well as a further embodiment of a hinge device 37. The panel-shaped elements 1*c* consist of two plates 51 and 52 which are disposed on either side of a square tube 50 and supported from one another by means of a glass fiber inlays 53. A square tube 58 is releasably secured to wall 21 by an angle iron 59 and wing nuts 65. The end hinge device 37 is connected to tube 58, as depicted in FIG. 8**.

FIG. 9 depicts in detail the hinge device 37 of FIG. 8. Each hinge device 37 includes two connecting portions 38 and 39 joined together by a joining portion 40. Each connecting portion 38, 39 has a smoothly curved outer wall 41 and an inner wall 42. One end of inner wall 42 is attached to one end of outer wall 41. The second end of each inner wall 42 is connected to the second end of the corresponding outer wall 41 by a respective sidewall 43. The junction of outer wall 41 and sidewall 43 of connecting portion 38 is joined to the junction of outer wall 41 and sidewall 43 of connecting portion 39 by joining portion 40. The exterior surface of curved outer wall 41 is convex, while the exterior surfaces of inner wall 42 and side wall 43 are preferably concave.

An anchor 44 extends from substantially the center of each inner wall 42. Anchor 44 is provided with a plurality of retention flanges 45 over its length.

FIG. 10 depicts a hinge device 37 joining two panel-shaped elements **1*c*. Each sidewall 50, 51 of the elements 1*c* terminates in an inwardly directed end member 46 and an angled flange 47 which define a retention slot 48 for receipt of anchor 44. One of the flanges 45 of anchor 44 engages flanges 47 to retain hinge device 37 and panel-shaped element 1*c* together. FIG. 10 illustrates the two panel-shaped elements 1*c*** substantially aligned.

FIG. 11 illustrates hinge device 37 joining two panel-shaped elements **1*d* which are articulated in a first direction, with the two outer walls 41 of hinge device 37 abutting to limit the extent of articulation. FIG. 11 illustrates an alternative technique for retaining hinge device 37 and the panel-shaped elements 1***d* together. A retention member 54 is positioned within each element 1*d*. Retention member 54 includes a back wall 55, side walls 56, inwardly directed end members 57, and angled flanges 60 which define a retention slot 61 for receipt of anchor 44. As with the embodiment of FIG. 10, one of the flanges 45 on anchor 44 engages flanges 60 to retain hinge device 37 and panel-shaped elements 1*d* together.

Figure 12:
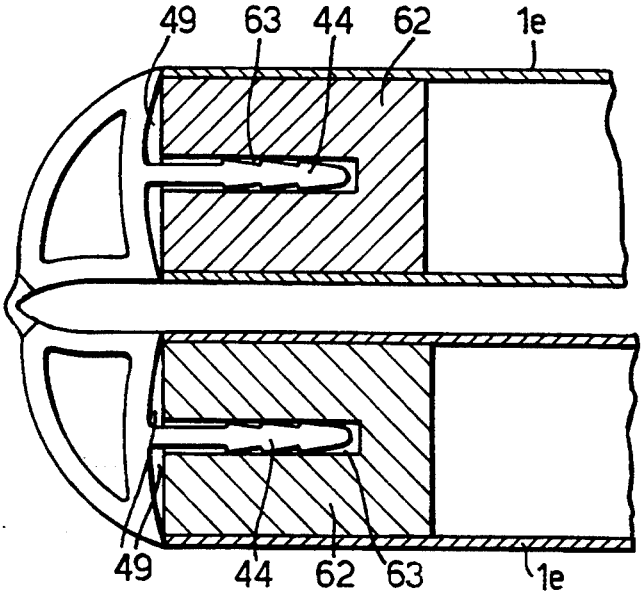
FIG. 12 is a fragmentary cross-section of a screen partition utilizing the hinge device of FIG. 9, the three figures depicting the hinge device in different orientations.

FIG. 12 illustrates hinge device 37 joining two panel-shaped elements 1*e* which articulated in the opposite direction, with the two inner walls 43 of hinge device 43 facing each other. FIG. 12 illustrates another technique for retaining hinge device 37 and the panel-shaped elements 1*e* together. Rather than the retention members 54 of FIG. 11, each element 1*e* has an elongated, solid retention block 62 with a retention slot or groove 63 therein for receipt of anchor 44. Groove 63 may be provided with flanges to cooperate with flanges 45 to retain anchor 44 within the groove.

The hinge devices 37 are made of a slightly resilient material such as a plastic. As can be seen in FIGS. 10–12, the hinge devices 37 contact the panel-shaped elements 1*e* at three points, providing improved stability. Further, the resiliency of the inner walls 42 results in a slight distortion of the hinge devices 37 when they are fully secured to the panel-shaped element 1*c*, 1*d*, 1*e*, so that the panel-shaped elements are more firmly gripped by the hinge devices 37.

As can be appreciated from FIG. 12, the smooth curved surface of outer walls 41 gives the finished partition a soft, undulating appearance in its retracted position. Likewise, as can be appreciated from FIG. 10, the extended partition has a pleasing, undulating appearance.

The curvature of inner walls 42 results in a small hollow space 49 between wall 42 and the end of the panel-shaped element 1*c*, 1*e*. An adhesive can be provided within the slot 48, 63 to more securely retain hinge device 37 and panel-shaped elements 1*c*, 1*e* together, if desired. Any excess adhesive will flow into the hollow space 49.

Figure 13:
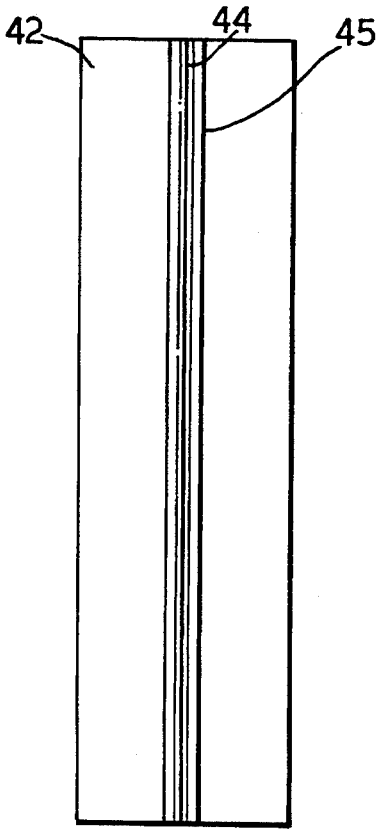
FIG. 13 is a rear plan view of the hinge device of FIG. 9.

Anchor 44 is preferably a continuous anchor member extending longitudinally along inner wall 42 over the length, or substantially the length, of hinge device 37, as depicted in FIG. 13. Alternatively, the anchor can be intermittent over the length of the hinge device, and might even be a plurality of circular anchors, spaced over the length of hinge device 37, for example at intervals in the order of 12 inches, in which event a plurality of like-spaced retention holes can be utilized instead of a retention slot.

In addition to considerable manufacturing and assembly-engineering advantages, the present invention affords major advantages as regards capability to adapt screen partitions to an existing environment, since all panel-shaped elements may be given any desired color whatever and may be produced from any optional material. Similarly, the hinge devices may be manufactured of any optional material in any optional color and may be combined with different colors and sizes of the panel-shaped elements.

Although the present invention has been described with reference to preferred embodiment, rearrangements, modifications, and substitutions can be made, and still the result will be within the scope of the invention.

What is claimed is:

1. A hinge device, comprising:

first and second body members, each body member including an outer wall portion having a first side edge and a second side edge, a curved inner wall portion having a concave surface and extending from said outer wall portion first side edge, a side wall portion extending from said outer wall portion second side edge to said inner wall portion, and an anchor portion extending from said inner wall portion concave surface in a direction away from said outer wall portion; and an articulation member joining the junction of said first body member outer wall portions and side wall portion to the junction of said second body member outer wall portion and side wall portion, said articulation member permitting continuous articulation of said first and second body members between a first position in which said first body member side wall portion faces said second body member side wall portion and a second position in which said first body member outer wall portion is abutting said second body member outer wall portion.

2. A hinge device as claimed in claim 1, wherein said inner wall portion is resilient.

3. A hinge device as claimed in claim 1, wherein each body member is hollow.

4. A hinge device as claimed in claim 3, wherein said outer wall portion, said inner wall portion and said side wall portion are resilient.

5. A hinge device as claimed in claim 1, wherein said anchor portion has at least one retention flange.

6. A hinge device as claimed in claim 1, made of a plastic material.

7. A hinge device as claimed in claim 1, made of aluminum.

8. A hinge device as claimed in claim 1, wherein said anchor portion is an elongated anchor portion extending substantially the length of said inner wall portion.

9. A hinge device as claimed in claim 1, wherein each of said outer wall portion and said side wall portion is curved.

10. An extendible and retractable screen partition apparatus, for partitioning an area of a room, said apparatus comprising:

a plurality of panel elements;

a plurality of hinge devices pivotally interconnecting said panel elements into an extendible and retractable partition having at opposite ends thereof a first end panel element and a second end panel element, with alternate ones of said hinge devices being pivotable in opposite directions to permit extension and retraction of said partition, each hinge device including (a) first and second body members, each body member having an outer wall portion with a first side edge and a second side edge, a curved inner wall portion having a concave surface and extending from said outer wall portion first side edge, a side wall portion extending from said outer wall portion second side edge to said inner wall portion, and an anchor portion extending from said inner wall portion concave surface in a direction away from said outer wall portion; and (b) an articulation member joining the junction of said first body member outer wall portion and side wall portion to the junction of said second body member outer wall portion and side wall portion, said articulation member permitting continuous articulation of said first and second body members between a first position in which said first body member side wall portion faces said second body member side wall portion and a second position in which said first body member outer wall portion is adjacent said second body member outer wall portion;

a releasable fastener for releasably securing said first end panel element to a wall of the room; and a telescopic support member extending downwardly from said second end panel element and adapted to contact a floor of the room to support said second end panel element, and thus said screen partition apparatus, thereon.

11. The apparatus as claimed in claim 10, further comprising a second telescopic support member extending downwardly from a centrally disposed one of said panel elements.

12. The apparatus as claimed in claim 11, wherein each support member includes a wheel.

13. The apparatus as claimed in claim 12, wherein each support member further includes a telescopic leg connecting said wheel to said panel element, and a spring for urging the wheel downwardly from the panel element.

14. The apparatus of claim 11, wherein each wheel is pivotable.

15. The apparatus of claim 11, wherein each wheel includes a brake.

16. The apparatus of claim 10, wherein each body member is hollow; wherein said outer wall portion, said inner wall portion, and said side wall portion are resilient; and wherein said anchor portion has at least one retention flange for engaging an opening in a partition panel.

17. A hinge member as claimed in claim 16, wherein said anchor portion is an elongated anchor portion extending substantially the length of said inner wall portion.

18. The apparatus of claim 16, wherein said outer wall portion and said side wall portion are curved.

19. An extendible and retractable screen partition apparatus, for partitioning an area if a room, said apparatus comprising:

a plurality of panel elements;

a plurality of hinge devices pivotally interconnecting said panel elements into an extendible and retractable partition having at opposite ends thereof a first end panel element and a second end panel element, with alternate ones of said hinge devices being pivotable in opposite directions to permit extension and retraction of said partition, each hinge device including (a) first and second body members, each body member having an outer wall portion with a first side edge and a second side edge, a curved inner wall portion having a concave surface and extending from said outer wall portion first side edge, a side wall portion extending from said outer wall portion second side edge to said inner wall portion, and an anchor portion extending from said inner wall portion concave surface in a direction away from said outer wall portion; and (b) an articulation member joining the junction of said first body member outer wall portion and side wall portion to the junction of said second body member outer wall portion and side wall portion, said articulation member permitting continuous articulation of said first and second body members between a first position in which said first body member side wall portion faces said second body member side wall portion and a second position in which said first body member outer wall portion is adjacent said second body member outer wall portion;

a releasable fastener for releasably securing said first end panel element to a wall of the room; and a telescopic support member extending downwardly from said second end panel element to a wheel adapted to contact a floor of the room to support said second end panel element, and thus said screen partition apparatus, thereon;

said telescopic support member including a telescopic leg connecting said wheel to said panel element, and a spring for urging said wheel downwardly from said panel element.

* * * * *